United States Patent [19]

Roxton

[11] 4,268,926

[45] May 26, 1981

[54] RESCUE TOOL

[75] Inventor: George F. Roxton, Wheeling, Ill.

[73] Assignee: Paratech Incorporated, Frankfort, Ill.

[21] Appl. No.: 965,577

[22] Filed: Dec. 1, 1978

[51] Int. Cl.[3] ..... B25D 1/04

[52] U.S. Cl. ..... 7/143; 7/167; 81/463; 30/367

[58] Field of Search ..... 7/143, 146, 147, 167; 30/367; 29/275; 81/52.35; 145/30.5; 173/91

[56] References Cited

U.S. PATENT DOCUMENTS

| | | | |
|---|---|---|---|
| 2,527,757 | 10/1950 | Mitchell | 81/52.35 UX |
| 2,574,605 | 11/1951 | Van Pelt | 173/91 X |

*Primary Examiner*—James G. Smith

*Attorney, Agent, or Firm*—Haight, Hofeldt, Davis & Jambor

[57] ABSTRACT

A rescue tool with an extended hollow housing has the shaft of a tool bit mounted in one end thereof for reciprocable motion. A substantially solid hammer is manually driven to strike the tool bit, the hammer extending the greater portion of the length of the housing when striking the tool bit. Manual actuation of the hammer is achieved by means of a shroud having a handgrip on its outer surface, the shroud being secured to the hammer at the end away from the tool bit. The hammer may be locked with respect to the housing to provide a pry bar of two different lengths. Securing the hammer to prevent complete withdrawal of the hammer from the housing is achieved by an easily removable snap ring arrangement.

13 Claims, 9 Drawing Figures

RESCUE TOOL

BACKGROUND OF THE INVENTION

1. Field of the Invention

The present invention relates to a rescue tool of the type used by emergency units, and more particularly, this invention relates to a rescue tool adapted to percussively actuate various types of tool bits and which may be selectively locked to provide a rigid pry bar.

2. Description of the Prior Art

Emergency units frequently encounter situations where barriers prevent their access to areas or persons, or where heavy objects must be shifted, or where some shape must be distorted. A common example is the necessity to gain access to a person or persons trapped in an automobile after a collision. Frequently, a variety of tools may have to be used to cut, punch or pry to achieve the required result. Those tools which are not hand-operated often require sources of power or auxiliary prime movers, which may be difficult to obtain at the scene of an emergency. Also, some types of tools may not be safely employed in some circumstances. For example, a cutting torch or cutting wheel, which may spark, when used at a vehicular collision site where gasoline is abundant may result in explosive combustion.

To meet the special requirements of emergency work, manually actuated specialized rescue tools have been developed. Each of these is, to a degree, a multifunctional tool which can be used to replace several single-function ordinary tools. The pick-pointed ax which has found nearly universal acceptance among firemen is an example of such a tool. Since it may be used to cut, punch and pry, the pick-pointed ax can in some circumstances render the separate use of an ax, punch and maul, and a crowbar unnecessary. However, the pick-pointed ax is not well suited for heavy work or cutting metal, and it obviously requires a skilled user with sufficient room to maneuver.

A more specialized tool is the forcible entry "Kelly Tool". This tool is designed to obtain entry through an ordinary door locked by usual means. For example, it has a protrusion particularly adapted to remove lock hasps. The "Kelly Tool", however, is not well suited for uses other than that particular use for which it was designed.

A more versatile type of rescue tool is illustrated by the "Ram Bar", which is manufactured by Partner Industries of America, Inc., the assignee of this application. The "Ram Bar" has an extended, relatively massive tool bit upon which an annular, relatively light hammer is impacted. It is a comparatively light, compact tool which may be used for cutting, punching and prying. While the "Ram Bar" has many desirable features, it is limited in its ability to generate high impact force at the working surface of a tool bit. Therefore, there is a need for a relatively light-weight, manually-actuated rescue tool that can provide high impact forces.

SUMMARY OF THE INVENTION

With the rescue tool of the present invention, such a relatively light-weight, manually-actuated rescue tool that can produce very high impact forces is provided. In addition, the rescue tool of the present invention may be easily converted to a relatively strong pry bar.

In the rescue tool of the present invention, an extended hollow housing is employed. In the preferred embodiment disclosed herein, this extended housing is in the form of a generally cylindrical tube.

A tool bit is located at one end of the housing, and a shaft of the tool bit is mounted for reciprocable motion in a relatively short length of the housing. A suitable retention spring is mounted on the housing to prevent separation of the tool bit from the housing. This retention spring has a pair of extending angled and bowed legs, first ends of which are pivotally mounted on a mounting block secured to the housing. The other ends of the arms are affixed to a depending U-shaped portion through which the shaft of the tool bit passes. An enlarged annulus is located on the tool bit shaft between the end of the housing and the U-shaped portion of the retention spring, in order to prevent removal of the tool bit and also to limit the extent to which the tool bit shaft extends into the housing. The arms of the retention spring are more widely separated adjacent the end of the housing, so that by placing the enlarged annulus adjacent the end of the housing, the retention spring may be pivoted to permit removal of the tool bit.

A portion of the mounting block for the retention spring extends into the interior of the housing to provide a flat surface. A corresponding flat surface is formed on the shaft of the tool bit. Engagement of these two flat surfaces provides a restraint to prevent relative rotation between the tool bit and the housing.

Impact force for the tool bit is provided by a substantially solid hammer that is inserted into the other end of the housing. By having this hammer extend for the greater portion of the housing, at the time of impact with the tool bit, very sizable impact forces may be achieved.

Actuation of the hammer is achieved by utilization of a shroud member that passes over the external surface of the housing and is secured to the end of the hammer away from the tool bit. A handgrip is located on the external surface of the shroud so that the hammer may be manually actuated. Another handgrip located on the housing, beyond the point at which the housing is covered by the shroud when the hammer strikes the tool bit, permits an operator to position the tool bit and steady the rescue tool at impact.

Connection of the shroud to the hammer may be achieved in any suitable fashion, such as by employing a separate heel member to which both the shroud and the hammer are secured. In the preferred embodiment disclosed herein, this heel member may be provided with an orifice extending therethrough to receive a suitable rod or handle. If desired, the rod may be releasably secured in a central position, such as by a spring biased ball arrangement. Such a handle permits more than one operator to work with the tool in a blow-striking or prying job.

In order to prevent complete withdrawal of the hammer from the housing, a suitable securing arrangement is utilized. In the preferred embodiment disclosed herein, this securing arrangement involves a snap ring that holds a suitable lock ring in place. The snap ring and the lock ring are placed over the end of the housing away from the tool bit and a suitable keeper flange is secured to that end of the housing, such as by welding. The keeper flange has an outer diameter greater than the outer diameter of the housing, but less than the inner diameter of the shroud. The lock ring is then placed in a counterbored portion at the end of the shroud toward the tool bit. A groove having a diameter greater than the diameter of the counterbored portion is formed in that portion, so that the snap ring may be placed in the groove to hold the lock ring in the counterbored portion of the shroud. Thus, when the hammer is moved away from the tool bit, the lock ring will engage the keeper flange to prevent complete withdrawal of the hammer from the housing. However, as a result of the use of the snap ring, which may be easily removed by a suitable tool, the shroud and hammer may be easily separated from the housing, when so desired.

As it is frequently desirable to preclude reciprocation of the hammer in the housing, such as when the tool is being carried or when it is desired to use the tool as a pry bar, a suitable lock structure is provided. This lock structure includes a lock passage extending through the hammer. This lock passage is located in the hammer at a point just beyond the end of the shroud, when the hammer has driven the tool bit to its maximum displacement from the housing. Suitable lock openings are formed in the housing at this point, at either end of the lock passage.

A suitable fastening pin may then be passed through the lock openings and the lock passage to prevent relative motion between the housing and the hammer. In order to prevent accidental dislodgement of the fastening pin, it is desirable to have a constraining device, such as a spring biased ball, that precludes withdrawal of the fastening pin until the constraining device is released. This locked position of the rescue tool is desirable for transportation from one location to another, or when a relatively short pry bar is required. It should be noted that the location of the lock passage is such that when the tool is locked in this position the annulus on the tool bit shaft is adjacent the U-shaped portion of the retention spring. Thus, an interlock is provided to prevent undesired removal of the tool bit from the housing.

Another lock position may be provided when the hammer is in its fully extended position. A second pair of lock openings diametrically opposite one another may be formed in the housing to align with the lock passage in the hammer to provide a long pry bar. By making the hammer of a steel which has some flexibility, with only the end of the hammer being made of the hard tool steel needed for impact, a very strong and non-brittle pry bar may be provided.

A holder for the fastening pin is mounted on the shroud. One end of the fastening pin is always secured to this holder, such as by a suitable chain or other flexible linkage. In this fashion, the ready availability of the fastening pin may be guaranteed.

A protective sheath of elastomeric material, such as rubber, is placed about the end of the shroud toward the tool bit. Thus, when the hammer is caused to strike the tool bit, an inwardly projecting portion of the protective sheath is between the end of the shroud and a projecting flange on the housing to protect a finger or hand inadvertently located therebetween, as well as cushioning and preventing metal-to-metal contact between those parts when the tool bit is not present. Further cushioning is provided by a suitable elastomeric ring between the keeper flange on the housing and the heel member interconnecting the hammer and shroud.

In this fashion, a compact rescue tool is provided which can replace multiple tools for generating high impact forces, and which can also furnish leverage by being locked in a rigid pry bar configuration. In addition to the provision of high impact forces and, alternatively, a rigid pry bar, the rescue tool of the present invention provides these desirable features in a compact, relatively light-weight, easily handled and easily maintained structure.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figures 1, 2, 3:
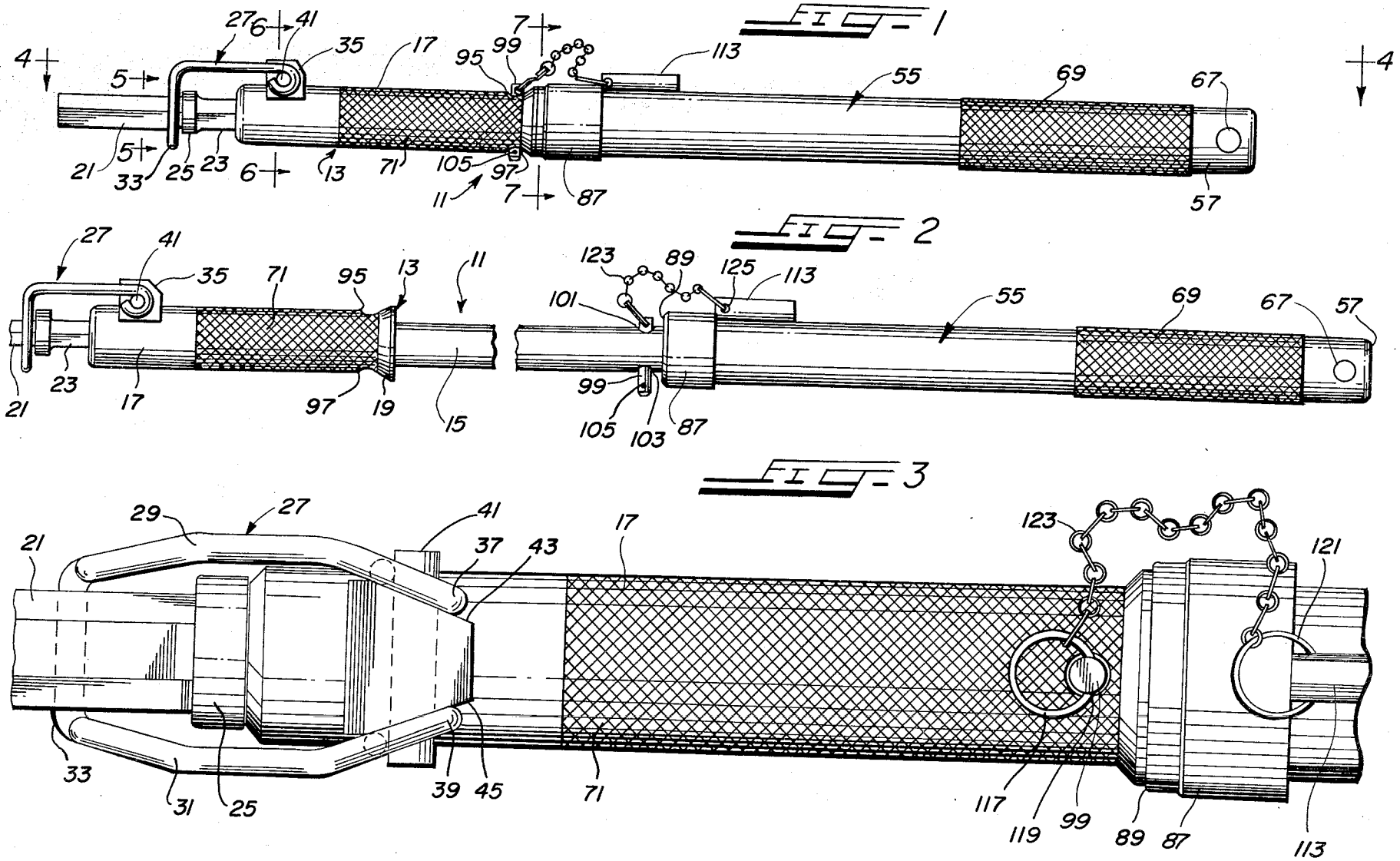
FIG. 1 is a elevational view of a rescue tool constructed in accordance with this invention.
FIG. 2 is an elevational view of the rescue tool of FIG. 1 in another position.
FIG. 3 is an enlarged top plan view of a portion of the rescue tool of FIG. 1.

A rescue tool 11 constructed in accordance with the present invention is illustrated in FIGS. 1 and 2. Rescue tool 11 has an elongated hollow housing 13. As best seen in FIG. 2, housing 13 has a smaller diameter portion 15 and a larger diameter portion 17. Portions 15 and 17 may be any suitable elongated hollow structures, either integrally formed or secured together. In this preferred embodiment, portions 15 and 17 are generally cylindrical and are secured together, such as by welding. As may best be seen in FIG. 4, portion 15 extends within portion 17. A protruding flange 19 is located at the end of portion 17.

A tool bit 21 is located at one end of housing 13. Tool bit 21 may be any of a variety of different tools. Each of the differing tools is provided with the same type of shank or shaft 23, so that the tools may be interchangeably inserted into housing 13.

Shaft 23 extends into housing 13 for reciprocable motion in a relatively short portion thereof. The extent to which tool bit shaft 23 extends into housing 13 is limited by an enlarged annulus secured to the tool bit. Annulus 25 has an outer diameter greater than the diameter of the opening through which the tool bit shaft 23 passes in the end of housing 13, thus limiting the extent of movement of shaft 23 into housing 13. Annulus 25 also serves to prevent removal of tool bit 21 from housing 13 by engaging a retention spring 27.

Figure 5:
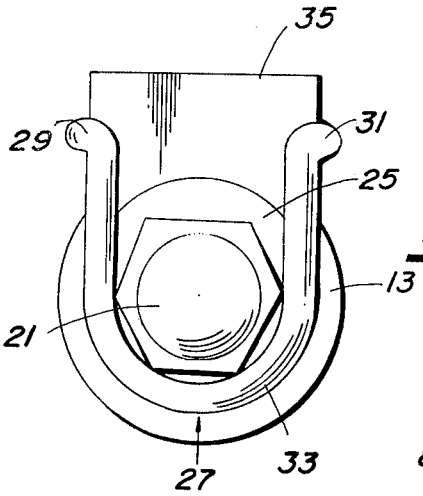
FIG. 5 is an enlarged cross-sectional view taken along line 5—5 of FIG. 1.

Retention spring 27, as may be seen from FIGS. 3 and 5, has a pair of angled, bowed legs 29 and 31. A U-shaped portion 33 depends from the ends of legs 29 and 31. Tool bit 21 extends through U-shaped section 33. Retention spring 27 is biased upwardly to engage the tool bit 21.

Retention spring 27 is pivotably mounted on a mounting block 35 which is secured to and extends into the interior of housing 13. Pivotal mounting of retention spring 27 is achieved by locating loops 37 and 39, formed in the ends of arms 29 and 31, respectively, over a pivot pin 41. Pivot pin 41 is secured in mounting block 35 and extends from either side thereof to receive the loops 37 and 39. As best seen in FIG. 3, mounting block 35 has tapered sides 43 and 45, the wedging action of which causes U-shaped portion 33 to engage tool bit 21. As may be noted in FIG. 3, arms 29 and 31 are separated by a greater distance adjacent the end of housing 13 than they are adjacent the U-shaped portion 33. Thus, when tool bit 21 is positioned with annulus 25 adjacent the end of housing 13, as illustrated in FIG. 3, retention spring 27 may be pivoted to permit removal of the tool bit 21. However, when tool bit 21 is positioned with annulus 25 adjacent U-shaped portion 33, annulus 25 cannot pass between legs 29 and 31. Therefore, tool bit 21 cannot be removed from housing 13 when annulus 25 is positioned adjacent U-shaped portion 33 of the spring 27.

Figure 6:
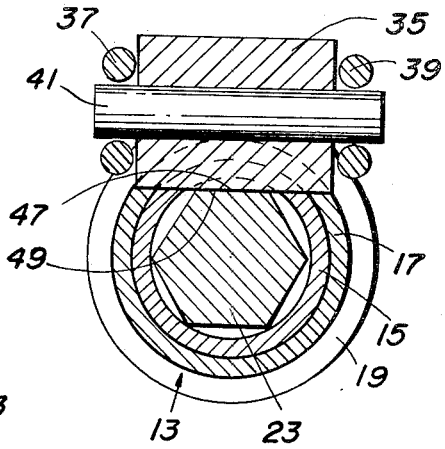
FIG. 6 is an enlarged cross-sectional view taken along line 6—6 of FIG. 1.

With reference to FIG. 6, it may be seen that a flat surface 47 of mounting block 35 is located in the interior of housing 13. Flat surface 47 engages another flat surface 49 formed on the shaft 23 of tool bit 21. The engagement of these flat surfaces precludes relative rotation between tool bit 21 and housing 13. Flat surface 49 on tool bit shaft 23 could be a single such surface, or the shaft 23 may be formed with mulitiple sides, such as the hexagonal shape shown.

A substatially solid hammer 51 is arranged for reciprocation in housing 13. Hammer 51 extends into housing 13 through the end away from tool bit 21. Hammer 51 is formed of a strong steel, with a section of tool steel at end 53. The vary hard tool steel 53 is required to withstand the high impact forces.

Figure 4:
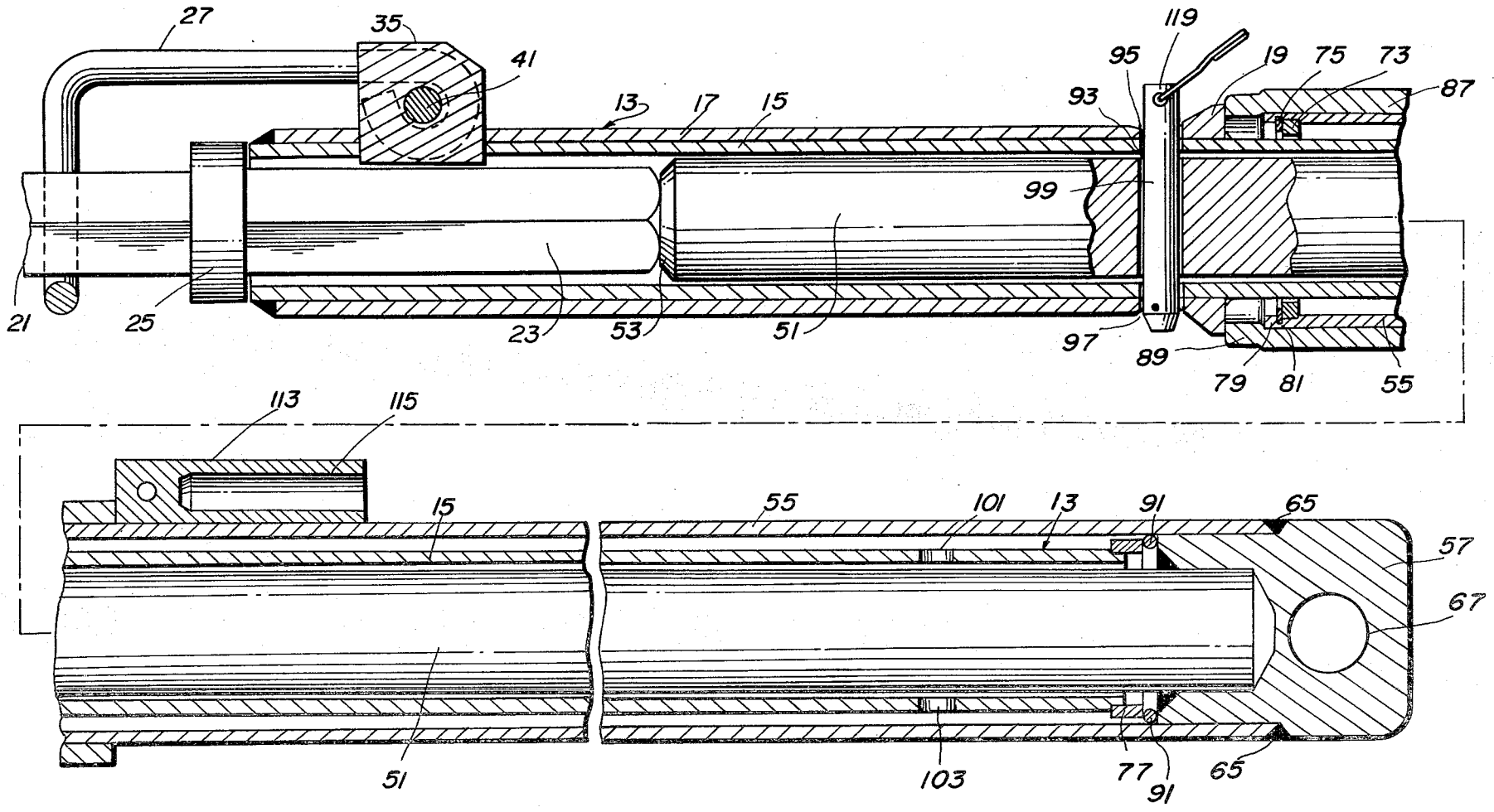
FIG. 4 is an enlarged cross-sectional view taken along line 4—4 of FIG. 1.
Figure 8:
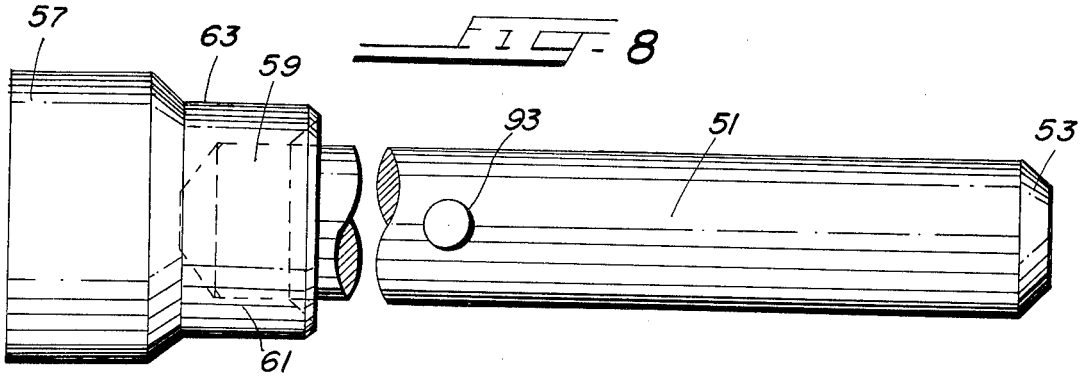
FIG. 8 is an enlarged assembly view of a portion of the rescue tool of FIG. 1.

Hammer 51 is fixedly attached to a shroud 55 that passes over a portion of the exterior surface of housing 13. Shroud 55 may be formed in a suitable fashion, such as from a generally cylindrical tube. Also, the fixed attachment between hammer 51 and shroud 55 may be achieved in any suitable fashion. In the preferred embodiment disclosed herein, hammer 51 and shroud 55 are separately attached to a heel member 57. In FIG. 8, it may be seen that end 59 of hammer 51 is inserted into an appropriate opening 61 formed in heel 57. The attachment between hammer 51 and heel 57 may be achieved in any suitable fashion, such as by a force fit or shrink fit. Shroud 55 may then be passed over the portion 63 of heel 57 to be secured thereto, such as by a weld 65 (FIG. 4). An orifice 67 is located through heel 57 to receive a rod or handle.

A handgrip 69 is located on the external surface of shroud 55 to provide for manual actuation of hammer 51. A similar handgrip 71 is located on the external surface of housing 13. Handgrip 71 is located on the tool bit side of flange 19, as flange 19 establishes the maximum coverage of housing 13 by shroud 55.

Figure 7:
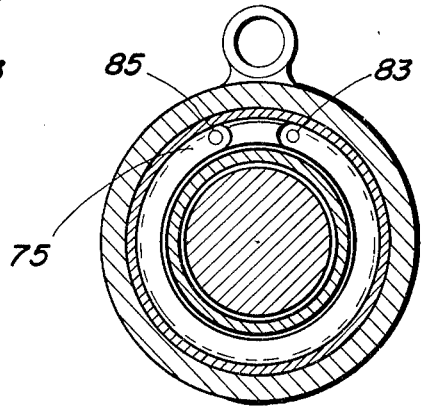
FIG. 7 is an enlarged cross-sectional view taken along line 7—7 of FIG. 1.

In order to prevent complete removal of hammer 55 from housing 13, a securing arrangement between shroud 55 and housing 13 is provided. This securing arrangement includes a lock ring 73 and a snap ring 75 (FIG. 4). Snap ring 75 and lock ring 73 are placed over portion 15 of housing 13, during construction of the tool. Then, a keeper flange 77 is fastened, such as by welding, to the end of housing 13 away from the tool bit. Shroud 55 is then passed over housing 13, and lock ring 73 is inserted into a counterbored portion 79 of shroud 55. Snap ring 75 is then placed into a groove 81 formed in the counterbored portion 79. Snap ring 75 holds lock ring 73 in position. As the hammer is withdrawn from the tool bit, lock ring 73 will engage keeper flange 77 to permit complete withdrawal of hammer 51 from housing 13. As may be seen in FIG. 7, holes 83 and 85 are formed in the ends of snap ring 75, so that by use of a suitable tool the snap ring may be pinched together to be removed from groove 81 and permit shroud 55 and hammer 51 to be completely separated from housing 13.

A protective sheath 87 may be located about the end of shroud 55 that is closest to tool bit 21. Protective sheath 87 is preferably formed from an elastomeric material, such as rubber. An end section 89 of sheath 87 extends inwardly over the end of shroud 55 so that upon hammer 51 striking tool bit shaft 23 the end of shroud 55 is separated from flange 19 on housing 13 by the elastomeric material to prevent serious injury to a finger or hand inadvertently located between these two members. Also, the protective function is supplemented by a cushioning effect and prevention of a metal-on-metal blow, in the event that the shroud 55 and hammer 51 are actuated when tool bit 21 is not in housing 13. A similar cushioning effect is achieved by utilization of an elastomeric ring 91 between heel 57 and keeper flange 77.

In order to prevent relative motion between hammer 51 and housing 13, when it is not desired to use the rescue tool as a percussive instrument, a lock structure is provided. This lock structure includes a lock passage 93 formed through hammer 51. A first pair of lock openings 95 and 97 are formed diametrically opposite one another in housing 13 adjacent flange 19 on the tool bit side thereof. Lock openings 95 and 97 align with opposing ends of lock passage 93, so that a suitable fastening pin 99 may be passed through the lock openings 95 and 97 and lock passage 93 to secure the rescue tool in the fixed position shown in FIG. 1. It may be noted that the lock passage 93 in hammer 51 is formed in a location such that when the fixed position of FIG. 1 is established tool bit 21 is positioned with annulus 25 adjacent U-shaped portion 33 of retention spring 27. Thus, in this position the tool bit 21 cannot be removed from housing 13, and accidental removal of the tool bit when the rescue tool is being carried in this position is precluded.

Another pair of lock openings 101 and 103 are formed in housing 13 near the keeper flange 77. When lock openings 101 and 103 are aligned with lock passage 93, fastening pin 99 may be utilized to lock the rescue tool in the position of FIG. 2. In this extended position, the rescue tool 11 can provide a relatively long pry bar to yield considerable leverage.

Figure 9:
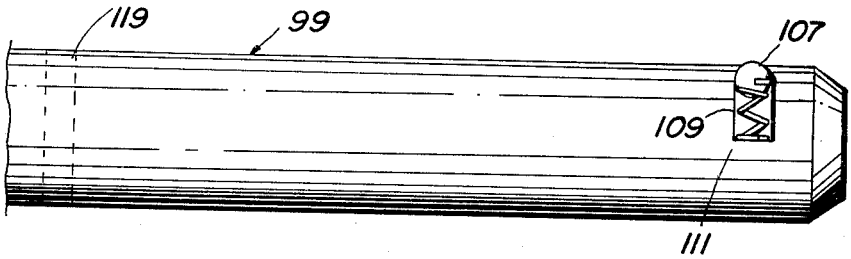
FIG. 9 is an enlarged cross-sectional view of a fastening pin employed in the rescue tool of FIG. 1.

When fastening pin 99 is passed through an appropriate pair of lock openings and the lock passage 93, it is desirable to be able to prevent accidental removal of the fastening pin 99. Therefore, a suitable constraining device 105 is provided. Constraining device 105 may take any appropriate form, but as shown in FIG. 9, in this preferred embodiment a spring-biased ball 107 is utilized. Ball 107 is located in a suitable opening 109 in pin 99, and a spring 111 holds the ball 107 partially protruding beyond the surface of the fastening pin 99. Of course, instead of a ball 107, a cylinder or other suitable structure could be utilized. In any event, the extension of ball 107 is sufficient to prevent fastening pin 99 from dropping out of the lock openings and lock passage 93. However, ball 107 may be easily depressed against the force of spring 111 to permit the fastening pin to be moved when so desired.

In order to make sure that fastening pin 99 is always available when it is desired to lock the rescue tool 11 in one of its positions, a holder 113 for the fastening pin 99 is mounted on shroud 55. Holder 113 has a suitable cavity 115 into which the fastening pin 99 may be inserted when not in use. Also, to preclude loss of the fastening pin, one end has a ring 117 passing through an opening 119 therein. Ring 117 is connected to another ring 121 by any suitable flexible linkage, such as a chain 123. Ring 121 is positioned in an appropriate opening 125 in the holder 113. From the foregoing, it may be seen that a very desirable rescue tool has been provided which can be alternatively utilized as a percussive device or as a pry bar.

It should be understood that various modifications, changes and variations may be made in the arrangement, operation and details of construction of the elements disclosed herein without departing from the spirit and scope of this invention.

I claim:

1. A rescue tool comprising:

an extended hollow housing;

a tool bit having a shaft mounted in one end of said housing for reciprocable motion within a relatively short length of said housing;

retention means for selectively preventing the removal of said tool bit from said housing and for limiting the extent to which said tool bit travels into said housing;

a substantially solid hammer extending into said holding from the end opposite said tool bit and mounted for reciprocable motion therein to strike said tool bit, said hammer extending for the greater portion of the length of said housing when striking said tool bit;

a shroud adapted to be gripped by the human hand and fitting over a portion of said housing with sufficient clearance to permit reciprocation relative thereto, said shroud secured to said hammer at the end of said hammer away from said tool bit to provide for manual reciprocation of said hammer with respect to said housing;

lock means for selectively preventing relative movement between said hammer and said housing to permit use of the rescue tool as a pry bar;

a keeper flange with an outer diameter greater than the outer diameter of said housing but slightly less than the inner diameter of said shroud, said keeper flange being mounted on the end of said housing away from said tool bit;

a counterbored portion of said shroud at its end toward said tool bit;

a groove formed in said counterbored portion of said shroud;

a lock ring having an outer diameter slightly less than the inner diameter of said counterbored portion of said shroud and an inner diameter less than the outer diameter of said keeper flange; and a snap ring to fit in said groove and hold said lock ring in said counterbored portion of said shroud, said lock ring engaging said keeper flange to prevent complete withdrawal of said hammer from said housing.

2. A rescue tool comprising:

an extended hollow housing;

a tool bit having a shaft mounted in one end of said housing for reciprocable motion within a relatively short length of said housing;

retention means for selectively preventing the removal of said tool bit from said housing and for limiting the extent to which said tool bit travels into said housing;

a substantially solid hammer extending into said housing from the end opposite said tool bit and mounted for reciprocable motion therein to strike said tool bit, said hammer extending for the greater portion of the length of said housing when striking said tool bit;

a shroud adapted to be gripped by the human hand and fitting over a portion of said housing with sufficient clearance to permit reciprocation relative thereto, said shroud secured to said hammer at the end of said hammer away from said tool bit to provide for manual reciprocation of said hammer with respect to said housing;

securing means for selectively preventing said hammer from being completely withdrawn from said housing;

a lock passage extending through said hammer transverse to the axis thereof;

a first pair of lock openings formed diametrically opposite one another in said housing, said lock openings adapted to align with the opposing ends of said lock passage;

a fastening pin to be inserted through said lock passage and said lock openings to lock the rescue tool in a fixed short form;

a second pair of lock openings formed diametrically opposite one another in said housing to lock the rescue tool in a fixed long form; and constraining means to prevent said fastening pin from being accidently dislodged from said lock passage.

3. A rescue tool as claimed in claim 2 wherein said constraining means comprises a ball spring biased in a direction transversed to the axis of said fastening pin.

4. A rescue tool as claimed in claim 2 and further comprising a holder for said fastening pin mounted on said shroud.

5. A rescue tool comprising:

an extended hollow housing;

a tool bit having a shaft mounted in one end of said housing for reciprocable motion within a relatively short length of said housing;

a substantially solid hammer extending into said housing from the end opposite said tool bit and mounted for reciprocable motion therein to strike said tool bit, said hammer extending for the greater portion of the length of said housing when striking said tool bit;

a shroud adapted to be gripped by the human hand and fitting over a portion of said housing with sufficient clearance to permit reciprocation relative thereto, said shroud secured to said hammer at the end of said hammer away from said tool bit to provide for manual reciprocation of said hammer with respect to said housing;

securing means for selectively preventing said hammer from being completely withdrawn from said housing;

lock means for selectively preventing relative movement between said hammer and said housing to permit use of the rescue tool as a pry bar;

an annulus affixed to said tool bit intermediate its ends, the outer diameter of said annulus being larger than the inner diameter of the length of said housing into which said tool bit reciprocates; and a retention spring mounted on said housing, said spring having a pair of angled, bowed legs and a depending U-shaped portion, the section of said legs of said spring adjacent said housing being sufficiently separated to allow the passage of said annulus when said spring is rotated with respect to said housing, the section of said legs adjacent said U-shaped portion not being separated enough to allow said annulus through them when rotation of said spring is attempted.

6. A rescue tool as claimed in claim 5 wherein said lock means may be utilized to secure said hammer in a position engaging said tool bit to maintain said annulus adjacent said U-shaped portion and prevent removal of said tool bit.

7. A rescue tool comprising:

an extended hollow housing;

a tool bit having a shaft mounted in one end of said housing for reciprocable motion within a relatively short length of said housing;

retention means for selectively preventing the removal of said tool bit from said housing and for limiting the extent to which said tool bit travels into said housing;

a substantially solid hammer extending into said housing from the end opposite said tool bit and mounted for reciprocable motion therein to strike said tool bit, said hammer extending for the greater portion of the length of said housing when striking said tool bit;

a shroud adapted to be gripped by the human hand and fitting over a portion of said housing with sufficient clearance to provide for manual reciprocation of said shroud with respect to said housing;

a heel member interconnecting said hammer and said shroud to provide for manual reciprocation of said hammer with respect to said housing;

securing means for selectively preventing said hammer from being completely withdrawn from said housing;

lock means for selectively preventing relative movement between said hammer and said housing to permit use of the rescue tool as a pry bar; and cushioning means for protecting an operator and for preventing high impact forces between components of the rescue tool other than said hammer and said tool bit.

8. A rescue tool as claimed in claim 7 and further comprising restraining means for preventing relative rotation between said tool bit and said housing.

9. A rescue tool as claimed in claim 8 wherein said restraining means comprises:

a first flat surface on said shaft of said tool bit; and a second flat surface on the interior of said housing upon which said first flat surface will bear when said tool bit is reciprocated within said housing.

10. A rescue tool as claimed in claim 7 and further comprising:

a first handgrip formed on the exterior surface of said shroud; and a second handgrip formed on the exterior surface of said housing beyond the point at which said housing is covered by said shroud during reciprocation.

11. A rescue tool as claimed in claim 7 wherein said heel member contains an orifice transverse to the axis of said hammer to receive a rod to provide a handle.

12. A rescue tool as claimed in claim 7 wherein said cushioning means comprises a sheath of elastomeric material which surrounds the outer surface of said shroud near the end toward said tool bit and which extends inwardly toward said hammer, so that a portion of said sheath is interposed between said shroud and said housing.

13. A rescue tool as claimed in claim 12 and further comprising a ring of elastomeric material which surrounds said hammer near said heel and which is interposed between said heel and said housing.

* * * * *